United States Patent [19]

Ellis

[11] 4,292,771

[45] Oct. 6, 1981

[54] SPLIT MULLION WINDOW FRAME DESIGN

[75] Inventor: James D. Ellis, Tigard, Oreg.

[73] Assignee: Viking Industries, Inc., Portland, Oreg.

[21] Appl. No.: 31,984

[22] Filed: Apr. 20, 1979

[51] Int. Cl.[3] ..... E04B 1/00; E06B 1/38

[52] U.S. Cl. ..... 52/98; 49/504; 52/99; 52/201; 52/213

[58] Field of Search ..... 52/98, 99, 201, 213; 49/504

[56] References Cited

U.S. PATENT DOCUMENTS

| | | | |
|---|---|---|---|
| 2,723,732 | 11/1955 | Pettersen | 524/476 |
| 2,916,112 | 12/1959 | Krehl | 52/98 |
| 3,160,243 | 12/1964 | Kelly et al. | 52/213 |
| 3,176,806 | 4/1965 | Ferrell | 52/213 X |
| 3,618,274 | 11/1971 | Vickerman | 52/98 |
| 3,769,775 | 11/1973 | Brzezinski | 52/731 |
| 3,868,804 | 3/1975 | Tantlinger | 52/98 |
| 4,009,546 | 3/1977 | Buck, Jr. | 52/201 |

OTHER PUBLICATIONS

Reynolds Aluminum, Series 60, 2 pages, A Brochure.

General Aluminum, Series 1900, 2 pages, A Brochure.

Better-Bilt Aluminum, Series 500, 2 pages, A Brochure.

Better-Bilt Aluminum, Series 510, 2 pages, A Brochure.

*Primary Examiner*—Alfred C. Perham

*Attorney, Agent, or Firm*—Klarquist, Sparkman, Campbell, Leigh, Whinston & Dellett

[57] ABSTRACT

A split mullion window frame has opposite frame members adapted for either attaching the window frame to adjacent building structure or to an adjacent such frame. Both frame members employ a nailing flange for attaching opposite sides of the frame to a building structure. According to the invention, outer portions of the nailing flanges are removable and the inner portion of one of the nailing flanges is offset so that, having removed the outer portions, the window frame members can be nested together with their respective inner flange portions overlapping. A second set of flanges is provided. They parallel the nailing flanges but are the same length as the inner portions of the nailing flanges. The second flanges are also mutually offset so as to overlap when the frame members are nested together, thereby forming a rigid interconnection between adjacent frame members of two windows mounted side-by-side without use of a separate mullion strip.

16 Claims, 11 Drawing Figures

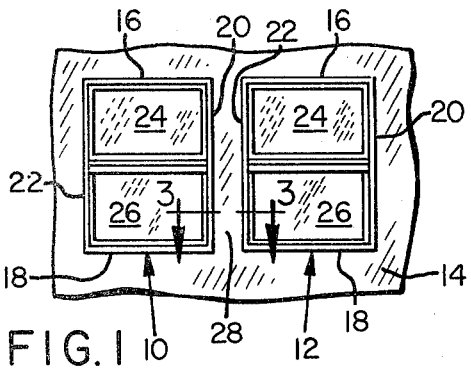
FIG. 1
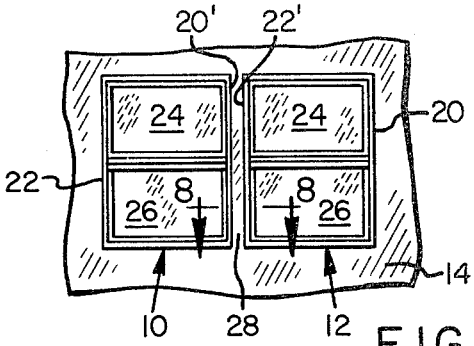
FIG. 2
FIG. 3
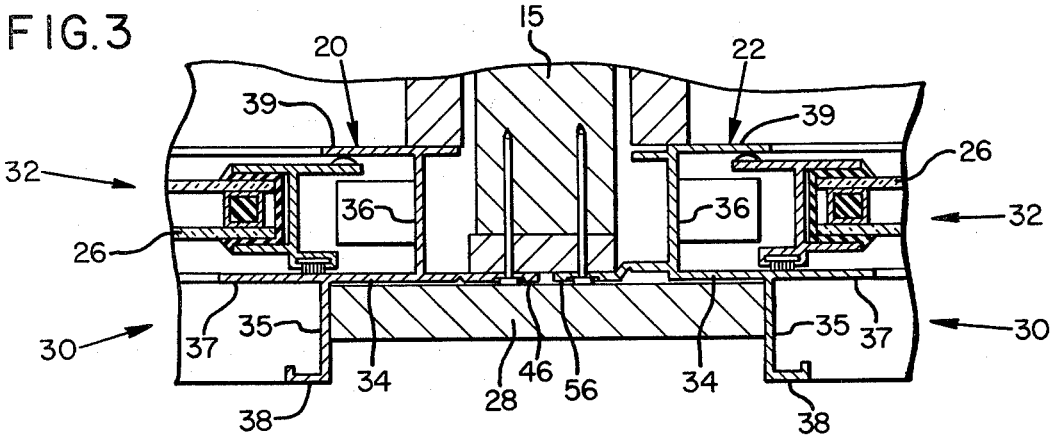
FIG. 4
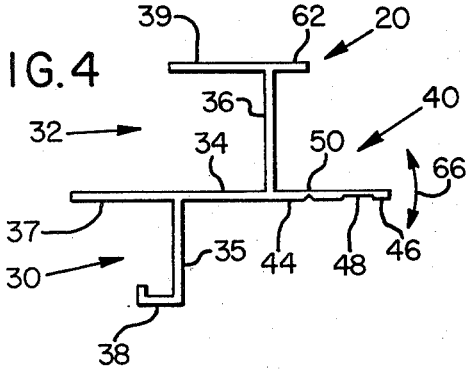
FIG. 5
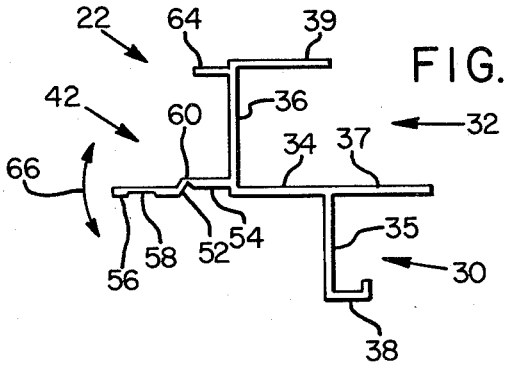
FIG. 6
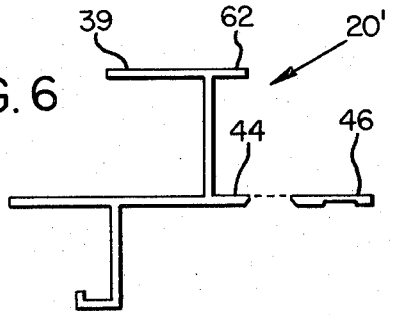
FIG. 7
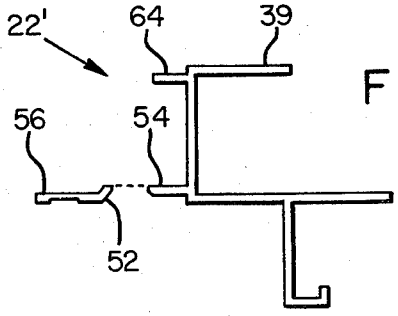

FIG.8
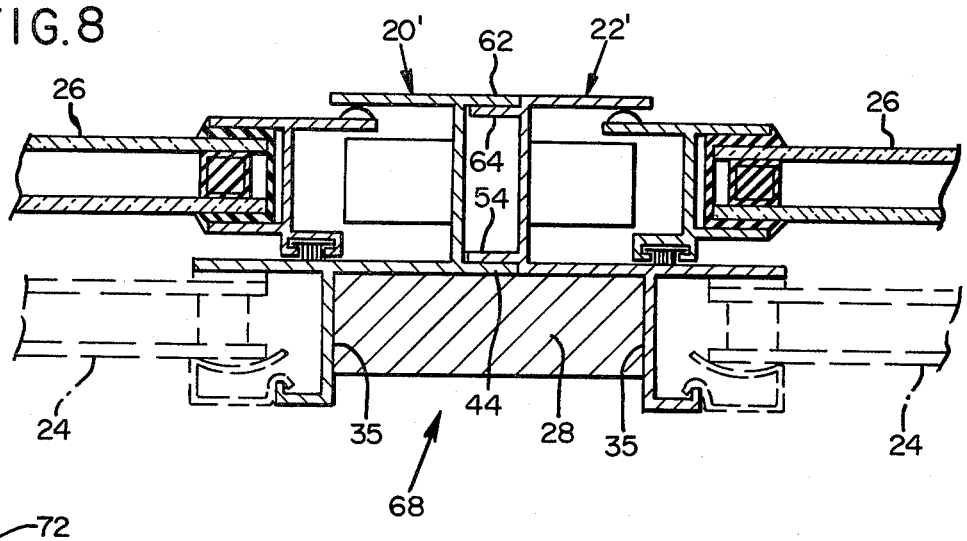
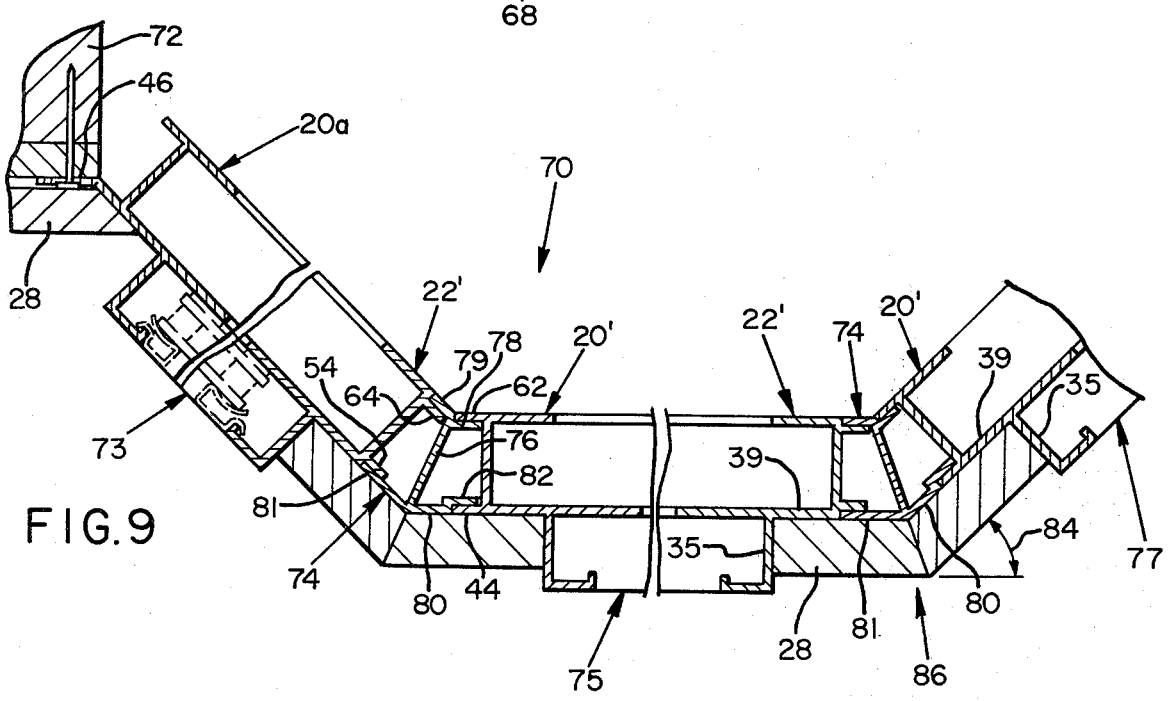
FIG.9
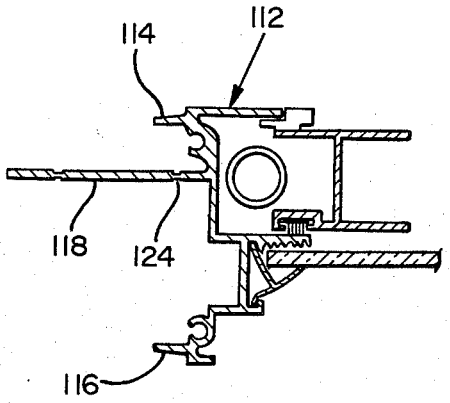
FIG.10 PRIOR ART
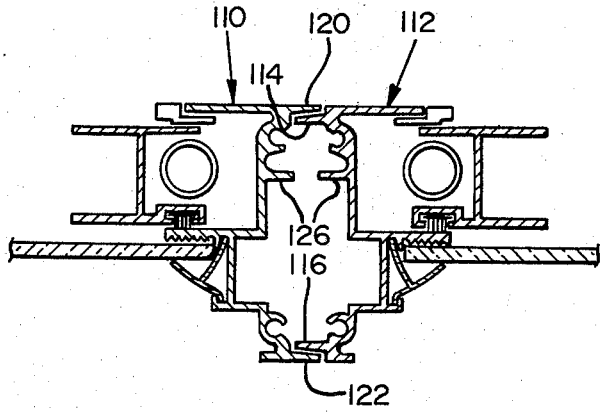
FIG.11 PRIOR ART

SPLIT MULLION WINDOW FRAME DESIGN

BACKGROUND OF THE INVENTION

1. Field of the Invention

The present invention relates to window frames, and more particularly to split mullion window frames adapted for attachment either to building structure about a window opening or to an adjacent frame within such opening.

2. Description of the Prior Art

Formerly, when it was desired to place two or more single- or double-hung windows close together in side-by-side (horizontal or vertical) abutting relationship in a building wall, a transition piece or mullion was used to adjoin adjacent window frames together. With the advent of extruded or molded window frames it has become common to use split mullion frame members which can be joined without the use of a transition piece, thereby reducing the costs of materials and labor for assembly. One example of a split mullion frame design is shown in U.S. Pat. No. 3,769,775 by K. J. Brzezinski.

However, such designs were limited in their application to the joining of multiple windows together. A different configuration of frame member was required for hanging single windows in a building wall or for joining the window frames at the end of an array of windows to a building wall. In the interest of economics it is preferable to have a single configuraion of window frame that is capable of serving both purposes.

At least one manufacturer, Better Bilt Aluminum Products Co. of Smyrna, Tenn., has tried to meet this need by providing a multi-purpose split mullion window jamb design in its Series 500 Vista-Line windows. The salient features of such jambs are shown in cross-section in FIGS. 10 and 11.

In FIG. 11 jambs 110 and 112 of two adjacent window frames are mated together, jamb 110 being the right jamb member of one frame and jamb 112 being the left jamb member of another frame. Jamb 110 has two spaced apart mating flanges 120, 122 extending toward jamb 112. Jamb 112 also has two mating flanges 114, 116 extending toward jamb 110, but flanges 114 and 116 are offset toward each other, so that, when jambs 110 and 112 are mated together, flanges 114, 116 nest between flanges 120, 122.

Referring to FIG. 10, jamb 112 also has a nailing flange 118 positioned between mating flanges 114 and 116. Flange 118 is used for attaching the jamb to a building wall, but is removable by means of a break-off notch 124, so that jambs 110, 112 can be mated together. Once the nailing flange is removed, all that remains is a vestigial stub 126 (FIG. 11). Although it is not shown in the drawings, jamb 110 is also provided with a removable nailing flange like that of jamb 112.

The Series 500 design meets the need for a single configuration split mullion frame, but entails material and tooling costs which it would be preferable to reduce. Use of three separate flanges, together with their supporting structure, requires more material than a lesser number of flanges would require. Also, considerable waste results because the nailing flange must be long enough to extend outwardly of the mating flanges for nailing, and yet be broken off to a length shorter than the mating flanges when mating two jambs together.

It would, therefore, be preferable to reduce the number of flanges required to accomplish the single configuration split mullion frame design. It would also be preferable to reduce the amount of material that is wasted when the nailing flange is removed.

Another disadvantage of previous split mullion window frames is the inadequate thermal barrier they provide at their exposed faces on opposite sides of the building wall. Referring to FIG. 11, mating flanges 114, 120 are positioned at the inner face of the building wall, while flanges 116, 122 are exposed at the outer face of the building wall. Being customarily constructed of extruded aluminum or other thermally conductive material, such frames are poor insulators. Consequently, the exposed outer surfaces of such frames should be shielded from the elements to reduce heat loss.

The Series 500 frame is unsuited to adding such shielding because of the position of the mating flanges. Preferably the nailing and mating flanges of a split mullion window frame would be positioned inwardly of the outer face of the building wall so that the outer surfaces of such flanges can be more easily shielded with insulative material. It would be further preferable if the junction of such frames could be shielded by the siding used on the building wall, such siding extending continuously from the wall over the region of the junctions between window frames.

SUMMARY OF THE INVENTION

It is therefore an object of the invention to provide a single configuration split mullion window frame which requires fewer than three flanges to accomplish the multiple use function of such frames.

It is another object of the invention to reduce the amount of material that is wasted when the nailing flange is broken off for mating such frames together.

A further object of the invention is to provide a split mullion window frame whose surfaces at the face of a building wall can be shielded, whether such frame is used alone or joined to a second such frame.

Yet another object is to shield such frames with a continuous extension of the siding of the building wall surrounding the frame.

The present invention combines the function of the nailing flange with the function of the mating flanges, so that at least one of the mating flanges can be omitted. Thus, the nailing or attachment flange has a removable outer nailing portion and an inner, mating portion offset laterally from the outer portion. The inner portion is offset laterally to an extent which allows it to overlie the inner mating portion of the attachment flange of an adjoining such window frame.

According to the invention, each frame member can also include a single mating flange spaced laterally apart from the attachment flange, the mating flange of one such frame member being offset laterally from the mating flange of the other frame member.

In another aspect of the invention the attachment flange is positioned laterally toward the center of the body, or main frame portion, of the frame member, thereby recessing the attachment flange from the face of the building wall. When two window frames are joined together a recessed channel is formed between the adjoining frame members. Building wall siding can then be placed in the recessed channel to shield and insulate the joined attachment flanges and the main frame portion of each frame member.

These and other features, objects and advantages of the invention will become more apparent from the detailed description of the preferred embodiment which follows with reference to the drawings.

BRIEF DESCRIPTION OF THE DRAWINGS

FIG. 1 shows two windows, including window frames of the invention, mounted side-by-side about an intermediate mullion.

FIG. 2 shows two windows, including window frames of the invention, joined together.

FIG. 3 is a horizontal sectional view taken along the line 3—3 of FIG. 1.

In FIG. 4, the window frame member of the left portion of FIG. 3 is shown segregated from its surrounding structure.

In FIG. 5, the frame member of the right portion of FIG. 3 is shown segregated from its surrounding structure.

FIGS. 6 and 7 show the frame members of FIGS. 4 and 5, respectively, with their nailing flanges removed.

FIG. 8 is a horizontal sectional view taken along line 8—8 of FIG. 2.

FIG. 9 is a horizontal sectional view of a portion of a bay window employing the frame members of the present invention.

FIG. 10 is a horizontal sectional view of one side of a split mullion window frame according to the prior art.

FIG. 11 is a horizontal sectional view of the frame of FIG. 10 joined together with a second window frame.

DETAILED DESCRIPTION OF THE PREFERRED EMBODIMENT

In FIG. 1, two window frames 10 and 12 are mounted side-by-side in a building wall 14 about a mullion 15 (FIG. 3). Each window frame has a head 16, a sill 18 and opposite frame members 20 and 22. Upper and lower window panels 24, 26 are mounted in each frame. A portion of the building siding 28 covers mullion 15.

In FIG. 3, frame members 20 and 22 each include two channels 30 and 32 in which window panels 24 and 25 are slidably mounted. Such channels in one frame member are essentially identical to those in the opposed frame member. Referring to FIGS. 4 and 5, each frame member has a main frame portion including a central web 34 parallel to window panels 24 and 26 and two perpendicular webs 35 and 36 extending in opposite directions from the central web to form the bottoms of panel-mounting channels 30 and 32. A flange 37 extends from central web 34 inwardly toward the window opening to form a common wall between channels 30 and 32. Flanges 38 and 39 extend from webs 35 and 36, respectively, parallel to flange 37, to form outer walls of channels 30 and 32.

Frame members 20 and 22 have attachment flanges 40 and 42 extending away from their respective window openings for attaching the frame either to adjoining building structure or to one another.

Flange 40 (FIG. 4) extends linearly from central web 34 in member 20. It includes an inner portion 44 and an outer portion 46 lying in the same plane. The outer portion 46 has a channel 48 extending along its length, the material at the base of the channel being sufficiently thin that nails or screws can be pounded therethrough. Between the inner and outer portions is a notch 50 defining means for removing the outer portion 46 from frame member 20.

Flange 42 (FIG. 5) extends from web 36 away from the window opening parallel to central web 34. It has an inner portion 54 offset from the central web, an outer portion 56 lying in the same plane as the central web, and an angled portion, or jog 52 connecting the inner and outer portions. Between jog 52 and inner portion 54 is a notch 60 defining means for removing outer portion 56 and jog 52 from member 22.

Frame member 20 (FIG. 4) has a second, or mating flange 62 opposite flange 39, extending away from the window opening, and parallel to flange 40. Similarly, member 22 (FIG. 5) has a second flange 64 opposite flange 39 but offset along web 36 toward flange 42. Flange 64 parallels inner portion 54.

The above-described design positions the outer portions 46 and 56 in the same plane—that of web 34—so that frame members 20 and 22 are properly aligned when the outer portions are used as nailing flanges for attaching the members to a building wall or mullion 15, as shown in FIG. 3. However, inner flange portion 54 is offset from outer portion 56 to an extent which permits nesting together of inner flange portions 44 and 54 when portions 46 and 56 are removed and members 20 and 22 are mated together. Flange 64 is similarly offset with respect to flange 62. This relationship is best illustrated by reference to the use of frame members 20 and 22 as split mullions in joining window frames 10 and 12 together, as described below.

OPERATION

Two or more window frames 10 and 12 can be joined side-by-side, as shown in FIG. 2, or vertically (not shown). This is done by removing outer portion 46 from frame member 20 and the outer portion 56 and angled portion 52 from the inner portion 54 of member 22. Removal is accomplished by grasping each outer portion with a plier or similar tool and bending it repeatedly through the arc indicated by arrow 66 in FIG. 4 and 5. Such bending stresses the material, preferably extruded aluminum, at the notch, gradually weakening the connection with the inner portion with the inner portion until the outer portion breaks off, as shown in FIGS. 6 and 7.

Having their respective outer portions removed, frame members 20′ and 22′ can now be mated together as shown in FIG. 8. Flange 54 and 64 are offset toward each other by amounts slightly greater than the thickness of flanges 44 and 62, respectively. Consequently, flanges 54 and 64 nest snugly between flanges 44 and 62, to hold window frames 10 and 12 in side-by-side relationship, as shown in FIG. 2. The overlapping flanges can be secured together by screws or other fasteners (not shown) or can be left unsecured to function as expansion joints.

When members 20′ and 22′ are joined together, as shown in FIG. 8, webs 35 define opposite sides of a recessed channel 68 on the outside of building wall 14. The bottom of recessed channel 68 is defined by inner portion 44 and central webs 34 of each frame member. The bottom of the channel is recessed sufficiently from the face of the building wall so that siding 28 can be extended into such channel. In this way an insulative layer of wood can be used to shield and insulate much of the surface of the joined frame members, thereby conserving heat. An advantage of this design is that the siding 28 in the recessed channel will be flush with other siding on the structure.

In a second application of the invention, frame members 20, 22 can be easily adapted for use in a bay window 70, as shown, in FIG. 9. Windows 73 and 77 are joined to the building wall 72 by bending the outer flange portions 46, 56 of their frame members 20, 22 (not shown) to an angle suitable for nailing the members to wall 72, as illustrated by frame member 20*a*. In this way the outer portions are positioned in a common plane for attachment to the outer face of the supporting building structure.

Windows 73, 75 and 77 are joined together at a desired angle, for example 45°, indicated by arrow 84, their respective frame members 20' and 22' being joined at such angle about intermediate angle bars 74. Angle bar 74 has a central web 76. At the inner end of web 76 are two short flanges 78 and 79 of approximately equal length. At the opposite end are two long flanges 80 and 81. Flanges 80 and 81 are also of approximately equal length, and their length is approximately twice the length of the short flanges.

The short flanges are positioned to mate with mating flanges 62 and 64. Thus, short flange 78 is offset toward long flange 80. The long flanges are similarly positioned for interfitting with the inner portions 44, 54 of the nailing flanges, long flange 80 having an offset outer portion 82. The offsets used in flanges 78 and 80 are determined by the dimensions of flanges 44 and 62 of member 20', as discussed previously.

Flanges 78 and 80 lie at an angle to flanges 79 and 81, respectively, which is commensurate with the desired angle between the window panels in the bay window, for example 45°. The bay window is assembled, with window 73 lying in a plane parallel to flanges 78 and 80 and window 75 lying in a plane parallel to flanges 79 and 81.

The flanges of members 20', 22' are joined to the flanges of angle bar 74 by screws or bolts (not shown) passing therethrough. Thus, multiple windows can be joined at a desired angle relative to one another to form a bay or bow window by using the same single-configuration frame members 20', 22' as are used in FIG. 2 to join two or more parallel windows together.

The joints between frame members 20', 22' and angle bar 74 lie within a recessed angular channel 86 whose sides are defined by webs 39 and flanges 81, 12. Thus, channel 86 can be fitted with insulative shielding material, such as siding 28, to reduce heat loss through the frame.

Having illustrated and described a preferred embodiment of the invention, it should be apparent to those skilled in the art that the invention can be modified in arrangement and detail. We claim as our invention all such modifications as come within the true spirit and scope of the following claims.

We claim:

1. A window frame comprising:

a pair of opposed frame members defining opposite sides of a window opening, and having means for mounting a window panel in said opening;

an attachment flange extending lengthwise of and outwardly from each of said frame members, for attaching opposite sides of said frame to a supporting structure;

said flanges each having an inner portion and an outer portion, the outer portions being positionable in a common plane for attachment of said pair of frame members to a common face of said supporting structure;

the outer portion of at least one of said flanges being removable and the inner portion thereof being laterally offset from the outer portion to an extent such that, when said outer portion is removed and said window frame is mounted side-by-side with another such frame, said inner portion overlies the adjoining flange of said other frame.

2. A window frame according to claim 1, in which said flanges extend in a direction away from said window opening, said outer portions being in a common plane parallel to said window panel.

3. A window frame according to claim 1, in which at least said one attachment flange includes separating means in a region between said inner and outer portions thereof for selectively removing said outer portion from said inner portion.

4. A window frame according to claim 1, in which each of said frame members includes a mating flange spaced apart from said attachment flange and extending lengthwise of and outwardly from said frame member; the mating flange in one member being offset toward said attachment flange to an extent such that said offset mating flange overlies said other mating flange when said window frame is joined with another such frame.

5. Apparatus according to claim 4, in which each of said frame members includes only one mating flange.

6. Apparatus according to claim 1, in which each of said frame members has one mating flange spaced apart from said attachment flange and extending lengthwise of and outwardly from said frame member; the mating flange in the member having said offset inner portion being offset toward the inner portion so that said inner portion and said offset mating flange fit between the flanges of said other frame.

7. Apparatus according to claim 1, in which said frame members include a main frame portion having a lengthwise-extending recessed region adjacent said attachment flanges; said regions cooperating, when two of said frames are joined together, to form a recessed channel for receiving a shielding.

8. Apparatus according to claim 7, in which said shielding includes building wall siding and said channel is recessed sufficiently for said siding to extend contiguously from the supporting structure into said channel.

9. In a window frame having opposed side frame members defining opposite sides of a window opening, with each of two opposed frame members having an attachment flange extending lengthwise thereof and in a direction away from said opening, and with each of said flanges including an inner flange portion and an outer flange portion separable by a longitudinal break-off groove, with the outer flange portions of opposed said flanges being capable of coplanar positioning, the improvement comprising:

the inner flange portion of one said flange being offset laterally from its outer flange portion.

10. In a window frame having opposed side frame members defining opposite sides of a window opening, with each of two opposed frame members having an attachment flange extending lengthwise thereof and in a direction away from said opening, and with each of said flanges including an inner flange portion and an outer flange portion separable by a longitudinal break-off groove, with the outer flange portions of opposed said flanges being capable of coplanar positioning, the improvement comprising:

the inner flange portion of one said flange being laterally offset from the inner flange portion of the other said flange such that said inner flange portions lie in parallel planes.

11. A window frame member adapted for either attachment to supporting building structure or joinder along a second window frame member having an attachment flange extending lengthwise along said second member and away from its respective window opening;

said window frame member comprising:

mounting means for mounting an edge of a window panel; and attachment flange means having a removable outer portion for attaching said window frame member to said building structure, and an inner portion offset laterally from said outer portion for joining said member to said second frame member when said outer portion is removed;

said inner portion being offset to an extent such that it overlies the attachment flange of said second frame members, when said members are jointed together.

12. A window frame member according to claim 11, in which said flange means includes separating means in a region between said inner and outer portions thereof, for selectively removing said outer portion from said inner portion.

13. A window frame member according to claim 12, in which said separating means includes a notch extending lengthwise along said flange.

14. A window frame member according to claim 11, including a mating flange means spaced laterally apart from said attachment flange means for mating with a mating flange in said second window frame member.

15. A window frame member for defining one side of a window opening, said frame member comprising;

a main frame portion, channel-defining means extending in one direction from said main frame portion for receiving a window panel, and a nailing flange extending along said frame member and from said main frame portion in a direction generally opposite the direction of extension of said channel-defining means;

said nailing flange having connected inner and outer flange portions, said outer flange portion being selectively removable from said inner flange portion, said inner and outer flange portions being laterally offset from one another when joined together.

16. A window frame member according to claim 15, in which said flange portions are offset from one another a distance approximately equal to the thickness of said inner portion.

* * * * *